United States Patent [19]

Dietze

[11] 4,007,369

[45] Feb. 8, 1977

[54] TUBULAR OVEN

[75] Inventor: Wolfgang Dietze, Munich, Germany

[73] Assignee: Siemens Aktiengesellschaft, Berlin & Munich, Germany

[22] Filed: Apr. 13, 1976

[21] Appl. No.: 676,618

[30] Foreign Application Priority Data

Apr. 23, 1975 Germany ..... 2518045
June 23, 1975 Germany ..... 2527927

[52] U.S. Cl. ..... 219/390; 13/25; 219/531; 219/539; 219/553

[51] Int. Cl.[2] ..... F27D 11/02

[58] Field of Search ..... 219/390, 530, 531, 535, 219/539, 552, 553; 13/20, 22, 25; 118/49; 338/334; 428/36, 398

[56] References Cited

UNITED STATES PATENTS

| | | | |
|---|---|---|---|
| 2,768,277 | 10/1956 | Buch et al. | 13/25 X |
| 2,851,579 | 9/1958 | Pfeiffer | 13/25 X |
| 3,436,171 | 4/1969 | Neichselbaum et al. | 219/390 |
| 3,641,249 | 2/1972 | Higgins | 13/22 |
| 3,776,809 | 12/1973 | Baumler | 428/36 |
| 3,823,685 | 10/1973 | Koepp | 118/49 |
| 3,851,150 | 11/1974 | Holzen | 219/553 |
| 3,962,670 | 6/1976 | Dietze | 338/334 |

*Primary Examiner*—Volodymyr Y. Mayewsky

[57] ABSTRACT

An improved tubular oven adapted for use in diffusion processing of semiconductors whose interior walls are comprised of polycrystalline silicon and whose exterior walls are comprised of phosphorous doped silicon. Block electrical contacts are located at opposed ends of such tubular oven and are comprised of conductive metal and graphite. A layer of thermal insulation circumscribes mid regions of such tubular oven.

5 Claims, 2 Drawing Figures

TUBULAR OVEN

BACKGROUND OF THE INVENTION

German Offenlegungsschrift No. 1,933,128 shows an arrangement for diffusing doping materials into a semiconductor material wherein a tube of crystalline gas-tight semiconductor material is used as a diffusion container which can be heated by way of applying thereto a voltage directly or with the help of high-frequency energy. The tube serving as heating member may have its opposed ends connected with electrodes or may be circumferentially surrounded by an induction heating coil. To facilitate a heating of the tube by induction heating, a ring made of conductive material, such as graphite, is applied about the tube. When the tube is directly heated by an applied voltage, the voltage becomes dependent on the conductivity of the tube semiconductor material, independently of the tube dimensions in order to achieve diffusion temperatures. In order to use relatively low voltages for the initiation of the heating process, the above-mentioned reference suggests the use of highly doped semiconductor material for the diffusion tube, which can be produced relatively cheaply. When a predeterminable heating temperature is reached, the conductivity of the tube becomes independent of the doping of the semiconductor material and dependent upon the tube dimensions.

Due to the gas-phase deposition technique employed for the production of a diffusion tube as taught, for instance, in German Pat. No. 1,805,870, wherein semiconductor material from a gaseous semiconductor compound is precipitated onto the outer surface of a carrier member such as graphite and the carrier member is removed without destroying the semiconductor material layer, the production of pure, gas-tight tubes made of semiconductor material, in particular silicon, have become possible. Such pure tubes are heatable by direct current passage only with preheating.

When doped semiconductor material is used for the diffusion tube as mentioned in German Offenlegungsschrift No. 1,933,128, it is possible to eliminate such a pre-heating sequence and to heat such tube directly. However, this arrangement suffers from the fact that an undesired interaction between the high doping and a semiconductor component member can occur during a diffusion operation utilizing such tube.

A directly heatable silicon tube is provided in German Offenlegungsschrift No. 2,253,411, which tube is produced in such a way that at least two layers are successively deposited on the circumferential surface portions of a carrier member provided for such deposition, and the outermost deposited layer is provided with a doping, while the innermost layer consists of highly pure silicon. In a tube of such construction, the tube outer doping does not influence a semiconductor member receiving a diffusion treatment therewithin. However, the problem of providing an electric contact for such a tube when such is used as a tubular oven for semiconductor diffusion processes is not solved in this Offenlegungsschrift.

An electrical contact arrangement for a silicon tube which is to be heated directly is described in German Offenlegungsschrift No. 2,340,225. Here, the silicon tube which is being heated is provided with a doping in the areas where current contacts are to be applied in the assembled oven. A lacquer which contains phosphorus is applied to tube areas to be doped. Upon subsequent heating, the lacquer volatilizes without residue, and the doping material is diffused into the silicon tube. Heating collars made of aluminum or an aluminum alloy are used as current contacts, and they are placed onto a support of graphite felt. In this construction, the problem of achieving a satisfactory electric contacting of a directly heatable silicon tube has not been solved with respect to temperature constancy and heating duration. This construction interferes essentially with the reproducability of diffusion processes conducted in the assembled oven.

BRIEF SUMMARY OF THE INVENTION

It is thus a principle task of this invention to provide an improved tubular oven adapted for use in diffusion processing of semiconductor elements which oven employs a silicon tube.

The tube employed in this oven is characterized by having interior walls comprised of substantially pure silicon (typically polycrystalline in composition) and by further having exterial walls comprised of phosphorous doped silicon. Such a tube is producable by gas phase deposition technology known to the prior art (as above indicated).

In such tubular oven, this tube is provided with electrical contact means which are so constructed and so interrelated to this tube that there is obtained an oven wherein the oven pre-heating period is shortened to a minimum value and wherein a desired oven temperature can be maintained with great constancy.

In this tubular oven, such results are achieved by a coaction between the various components. The phosphorous doping associated with the tube external walls facilitates in combination with the electrical contact means rapid tube heating by a directly applied voltage, while the interior wall regions are maintainable at precisely controlled temperatures.

Various additional advantages, aims, purposes, objects and the like will be apparent to those skilled in the art for the present invention taken with the accompanying drawings.

DETAILED DESCRIPTION

Figure 1:
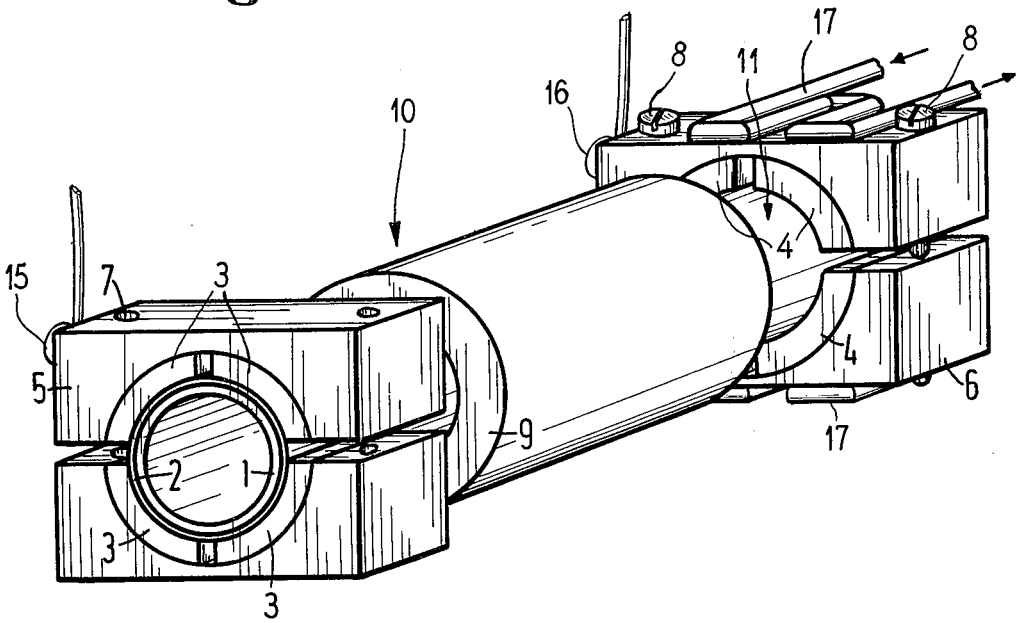
FIG. 1 is a pseudo-perspective view of one embodiment of a tubular oven of the present invention, some parts thereof removed.
Figure 2:
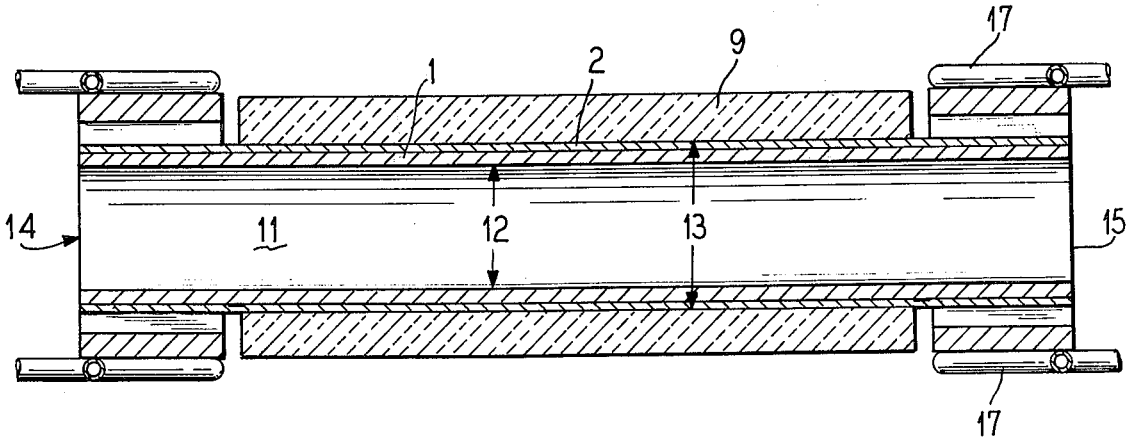
FIG. 2 is an axially extending vertically taken sectional view through the embodiment shown in FIG. 1.

In this invention, the silicon tube employed in an oven can be prepared, for example, by the teachings of German Offenlegungsschrift No. 2,253,411. Preferably, this tube comprises a highly pure silicon layer adjacent its interior circumferentially extending wall surfaces, and a phosphorous doped silicon layer adjacent its exterior circumferentially extending wall surfaces, the doping thereof being sufficient to produce a specific electric resistance ranging from about 2 through 200 microohm-centimeters (measured at ambient temperatures).

In an oven of this invention, opposed end portions of the silicon tube with its integral exterior phosphorous-doped layer are mounted in adjacent contacting relationship to conductive graphite support means. In turn, radially (relative to such tube) outer surface portions of such graphite support means are contacted and encased by highly conductive metal block means (which are preferably comprised of copper). The combination of metal block means plus associate graphite support means comprises electrical contact means at each opposed end of the silicon tube.

In a preferred embodiment, the silicon tube may have a bandshaped region of strong doping extending circumferentially over the entire length of the outer surface portions of the tube.

In order to obtain generally optimum conditions for dimensioning the graphite supports with respect to the achievement of a constant temperature profile in a tubular oven, the graphite supports are dimensioned in such a way that the ratio of the outer diameter of the silicon tube to the total axial contacting length of the graphite supports at each opposed tube end is not greater than about 10:1. In a particularly preferred embodiment in accordance with the teachings of the invention, this ratio is in the area of about 2:1. With such a ratio, as good a heat removal as possible is obtained at each tube end, and also a good contacting area between graphite supports and tube ends results.

The dimensioning of the graphite surface area which contacts external circumferential surface portions of the tube is important, i.e., the area on the tube circumference which is to be contacted in relation to the tube diameter employed is important. The length of the tube may be randomly selected and may be independent of contact areas. The preferred contact area on the tube circumference at each tube end may be obtained by computation from the ratio of the tube diameter ($d$) to the tube length which is to be contacted. The contact area at each respective tube end for graphite contact(s) at that end thus typically falls in the range from about $1 \times d^2$ and $2 \times d^2$[cm.$^2$]. The external electric contact achieved with the conductive metal block means at each tube end may be randomly dimensioned. Preferred proportions for the entire arrangement may be learned from the sample embodiment herein described.

It has also proven to be particularly advantageous in the practice of this invention to have tube ends with exterior respective radii which closely match the respective radii of the graphite supports employed. For this purpose, the end regions of a silicon tube can be ground round, if desired. Similarly, the metal blocks preferably have surfaces which make close, face-to-face contact with the graphite supports adjacent thereto.

Copper as a construction material for the metal blocks has advantages on account of improved contacting and electric conductivity. Aluminum may also be used, however, it cannot be as readily contacted. A copper block has advantages also as regards ease of water cooling thereof and as regards mechanical compression strength. Segmented graphite supports are preferred on account of improved compacting pressure performance characteristics relative to the tube. The better the pressure, the better the contact resistance (up to the point of tube collapse).

In accordance with a particularly preferred embodiment in accordance with the teachings of the invention, the graphite supports and/or the copper blocks are each formed of a plurality of segments which are adapted to be in adjacent but circumferentially spaced relationship to one another about and in relation to the silicon tube. Any convenient mechanical mounting means may be employed to clamp and maintain the silicon tube, the graphite supports and the metal blocks in a desired interrelationship relative to one another. For example, screws interconnecting the metal blocks with one another may be employed.

The metal blocks are preferably provided with cooling means which prevents localized overheating and aids in maintaining a desired constant oven temperature during operation thereof.

Preferably the apparatus of the present invention is provided with a thermal insulation layer or blanket located about circumferentially exterior surfaces of the tube between the pair of electrical contact means (preferably in axially spaced, adjacent relationship to the latter). This blanket can be of any desired construction. For example, and preferably, such can be comprised of a thermally stable material, such as a layer of aluminum silicate fibers. For another example, this insulative layer can comprise a heat reflective metal sleeve. This layer aids in maintaining constant and desired high temperatures inside the silicon tube during operation of the oven of this invention.

Referring to the illustrative embodiment depicted in the drawings, there is seen an oven of this invention herein designated in its entirety by the numeral 10. Oven 10 has a silicon tube 11 which here is about 32 cm in length, with an inner diameter 12 of about 26 mm and an outer diameter 13 of about 31 mm. Tube 11 is open on its opposed ends 14 and 15. Tube 11 has an interior layer 1 comprised of substantially pure polycrystalline silicon extending over the entire interior circumferential regions of tube 11. The tube 11 also has an exterior layer 2 (of 0.5 mm depth) consisting of silicon highly doped with phosphorous and having a specific resistance of about 3 microohm-centimeters which extends over the entire outer circumferential regions of tube 11. The silicon tube 11 is supported by and contacted with at the opposed ends graphite support sets 3 and 4, respectively. Each set 3 and 4 is comprised of four members arranged in circumferentially substantially equally spaced relationship to one another, each set 3 and 4 being at a different end of tube 11. Each individual graphite support member is about 25 mm in axial thickness and about 4,5 mm in radial thickness. The spacing between member ends can vary but is generally preferably at least about 250 mm. Each individual such member has a curvature such that it is adapted to make face-to-face engagement with adjoining surfaces of tube 11.

Each set 3 and 4 of graphite support members is held in place by respective pairs of copper blocks sets 5 and 6. Each block set 5 and 6 is itself composed of halves which are adapted to mount over the radially outer surfaces of sets 3 and 4, respectively. Each block set has an axial thickness about equal to the axial thickness of sets 3 and 4. Each block set half is about equal to the others in size. In each block set half adjacent the transversely opposed end portions thereof a chennel 7 is provided which is adapted to receive therethrough screw or nut and bolt assemblies 8 which function as positioning and clamping means for the subassembly of block sets 5 and 6 with support sets 3 and 4. The sizing of the individual block set halves is such that they are preferably in spaced, adjacent relationship to one another in the assembled oven 10, the spacing therebetween ranging from about 0.5 to 2 cm. The graphite supports with respect of each tube end 14 and 15 are dimensioned in such a way that the ratio of outer diameter 13 of the tube 11 to contacting length of the graphite cheeks along the tube surface is about 2:1; thus, each graphite support extends circumferentially over tube 11 a distance of about 15 mm.

Electric terminals 15 and 16 (not detailed) are provided for each block set 5 and 6. The block sets 5 and 6 are each provided with tubes 17 for conducting cooling water therethrough during operation of oven 10.

A thermal insulator layer 9 of approximately 30 mm thickness is positioned circumferentially about the heated portions of tube 11 between the opposite ends 14 and 15 thereof. Preferably layer 9 is axially spaced at each opposed end thereof from respective sets 3 and 4, and sets 5 and 6. A very good temperature constancy is achieved even in the case of high diffusion temperatures so that a zone of very even temperature over a fairly large portion of the tube 11 interior is gained during operation of oven 10.

A voltage of about 10V is applied in order to obtain a diffusion temperature of about 1300° C, at a current strength of about 100 amperes. The pre-heating period is typically about 60 minutes.

An oven of this invention may be conventionally used as a diffusion furnace. In the tube interior during oven operation a zone is characteristically produced which is constant in temperature. In such zone semiconductor crystal disks can be diffused and/or annealed. If desired, an oven can be provided with additional connections for flushing with gas.

Other and further objects, aims, purposes, alternative embodiments and the like will be apparent to those skilled in the art from a reading of the present specification and appended drawings, without departing from the spirit and scope of this invention.

The claims are:

1. An oven comprising

A. a tubular member having an interior layer comprised of polycrystalline silicon and an integral exterior layer comprised of phosphorous doped silicon having a specific resistance ranging from about 2 through 200 microohm centimeters, B. a pair of electrical contact means, each such contact means being in contact with a different opposed end region of said tubular member, each such contact means having

1. a plurality of circumferentially spaced adjacent graphite support members in face-to-face engagement radially with exterior layer portions of said tubular member,

2. a plurality of circumferentially spaced electrically conductive metal blocks in face-to-face engagement with radially outer surface portions of said graphite support members, and

3. clamping means securing said support members and said blocks together at and about said opposed end regions C. a thermally insulative layer circumferentially extending around said tubular member between said pair of electrical contact means but in axially spaced, adjacent relationship thereto, and D. means for cooling said pair of electrical contact means, said means for cooling comprising tubing adapted for conveying a cooling fluid in heat-exchange relationship to said metal blocks.

2. The oven of claim 1 wherein the ratio of outer diameter of the silicon tube to the contacting length of the graphite cheeks at each tube end along the tube is not greater than 10:1.

3. The oven of claim 2, wherein said ratio is about 2:1.

4. The apparatus of claim 1 wherein said insulation layer comprises alumino-silicate fibers.

5. The apparatus of claim 1 wherein said insulative layer comprises a heat reflective metal sleeve.

* * * * *